US006524157B1

(12) United States Patent
Ryan

(10) Patent No.: US 6,524,157 B1
(45) Date of Patent: Feb. 25, 2003

(54) TAPE RECORDER AND ANIMAL SHAPED CHILD'S TOY COMBINATION

(76) Inventor: Christine A. Ryan, 1390 Saratoga St., Pocatello, ID (US) 83201

( * ) Notice: Subject to any disclaimer, the term of this patent is extended or adjusted under 35 U.S.C. 154(b) by 115 days.

(21) Appl. No.: 09/599,667

(22) Filed: Jun. 22, 2000

(51) Int. Cl.[7] ..... A63H 3/28

(52) U.S. Cl. ..... 446/299; 446/297; 446/270

(58) Field of Search ..... 446/72, 73, 76, 446/77, 78, 81, 268, 270, 297, 299, 302, 315, 397, 404, 409, 71, 175, 318, 411

(56) References Cited

U.S. PATENT DOCUMENTS

| | | | | | |
|---|---|---|---|---|---|
| 2,385,914 | A | * | 10/1945 | Generale | |
| 2,514,450 | A | * | 7/1950 | Kopf | 446/270 |
| 4,017,905 | A | | 4/1977 | Convertine et al. | |
| 4,186,519 | A | * | 2/1980 | Repka | 46/202 |
| 4,272,915 | A | * | 6/1981 | Noble | 46/232 |
| 4,673,371 | A | * | 6/1987 | Furukawa | 446/175 |
| 4,793,010 | A | | 12/1988 | Gross et al. | |
| 4,878,871 | A | * | 11/1989 | Noto | 446/302 |
| 4,993,061 | A | | 2/1991 | Hsieh | |
| 5,059,149 | A | * | 10/1991 | Stone | 446/73 |
| 5,100,362 | A | * | 3/1992 | Fogarty et al. | 446/272 |
| 5,393,257 | A | | 2/1995 | Spector | |
| 5,474,484 | A | | 12/1995 | Lemelle | |
| 5,603,652 | A | * | 2/1997 | Rothschild et al. | 446/297 |
| 5,632,375 | A | | 5/1997 | Mattikow | |
| 5,749,764 | A | | 5/1998 | Bailey | |
| 5,775,970 | A | * | 7/1998 | Klees et al. | 446/297 |
| 5,803,786 | A | | 9/1998 | McCormick | |
| 6,171,172 | B1 | * | 1/2001 | Foster et al. | 446/270 |

FOREIGN PATENT DOCUMENTS

| | | | | |
|---|---|---|---|---|
| GB | 645353 A | * | 11/1950 | 446/270 |
| GB | 2029715 A | * | 3/1980 | A63H/3/33 |
| GB | 2185895 A | * | 8/1987 | A63H/3/28 |
| GB | 2226961 A | * | 7/1990 | A63H/30/02 |

OTHER PUBLICATIONS

Dogg13z (TM), website: http://www.gollygee.com/weblogs/jblocksom/viridian/robo, copyright 2002.*

* cited by examiner

*Primary Examiner*—Derris H. Banks
*Assistant Examiner*—Urszula M Cegielnik
(74) *Attorney, Agent, or Firm*—John D. Gugliotta

(57) ABSTRACT

A pull along toy for a child is provided with an integral cassette recorder. The invention will take the shape of an animal such as a dog, a cat, a lion or the like. A cassette recorder would be built into the back of the animal. An integral speaker is provided. The leash of the animal is formed by a strong electrical cable exiting from the neck area of the animal. Located at the end of the leash/cable is a microphone, for use in recording audio content.

5 Claims, 3 Drawing Sheets

TAPE RECORDER AND ANIMAL SHAPED CHILD'S TOY COMBINATION

RELATED APPLICATIONS

The present invention was first described in Disclosure Document No. 468,501, filed on Feb. 07, 2000. There are no previously filed, nor currently any co-pending applications, anywhere in the world.

BACKGROUND OF THE INVENTION

1. Field of the Invention

The present invention relates generally to special receptacles for holding a tape and the like and, more particularly, to a tape recorder aesthetically concealed within an creature-shaped child's toy.

2. Description of the Related Art

The toy industry is a multibillion dollar, global industry that is continually growing as more and more products are developed and introduced to the buying public. The toy industry is somewhat unique in the sense that it is highly susceptible to trendy products or fads. This is due most likely to the fact that children fall easily to peer pressure and, as a result, when a toy product achieves a certain level of popularity among children, demand can skyrocket in a domino effect manner. Items that are otherwise conventional dolls that have achieved enormous, even record, popularity based primarily on their attractiveness to children.

Accordingly, there is a constant need for new children's toys.

A search of the prior art did not disclose any patents that read directly on the claims of the instant invention; however, the following references were considered related.

The following patents disclose a combined functional toy and cassette holder: U.S. Pat. No. 5,632,375 issued in the name of Mattikow; and U.S. Pat. No. 4,017,905 issued in the name of Convertine et al.

U.S. Pat. No. 5,803,786 issued in the name of McCormick describes a continuous play musical mobile.

U.S. Pat. No. 5,749,764 issued in the name of Bailey discloses a soft sculpture character having storage pockets and a tape recorder.

U.S. Pat. No. 5,474,484 issued in the name of Lemelle describes a doll that plays a recorded tape.

U.S. Pat. No. 5,393,257 issued in the name of Spector discloses a toy figure and headset assembly with a portable audio tape cassette player.

U.S. Pat. No. 4,993,061 issued in the name of Hsieh describes a portable miniature high fidelity stereo tape player.

U.S. Pat. No. 4,793,010 issued in the name of Gross et al. discloses a baby rocker apparatus with a tape recorder.

Consequently, a need has been felt for providing additional novel designs with new functionality not seen in the prior art.

SUMMARY OF THE INVENTION

Therefore, it is an object of the invention to provide a tape recorder aesthetically concealed within a child's toy.

It is another object of the present invention to provide such a tape recorder having a microphone remote mounted from a tape recorder, both aesthetically concealed within a child's toy.

Briefly described according to one embodiment of the present invention, is a pull along toy for a child is provided with an integral cassette recorder. The invention will take the shape of an animal such as a dog, a cat, a lion or the like, or other type of walking or crawling creature, such as a bug or the like. A cassette recorder would be built into the back of the animal and provide common functions such as play, record, fast-forward, rewind and stop. An integral speaker is provided with a volume control. The leash of the animal is formed by a strong electrical cable exiting from the neck area of the animal. Located at the end of the leash/cable is a microphone, for use in recording audio content. When not in use, the microphone is stored in a snap-in compartment on the chest area of the animal.

Thus, a child may pull the toy by the leash and/or sing or talk into the microphone.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
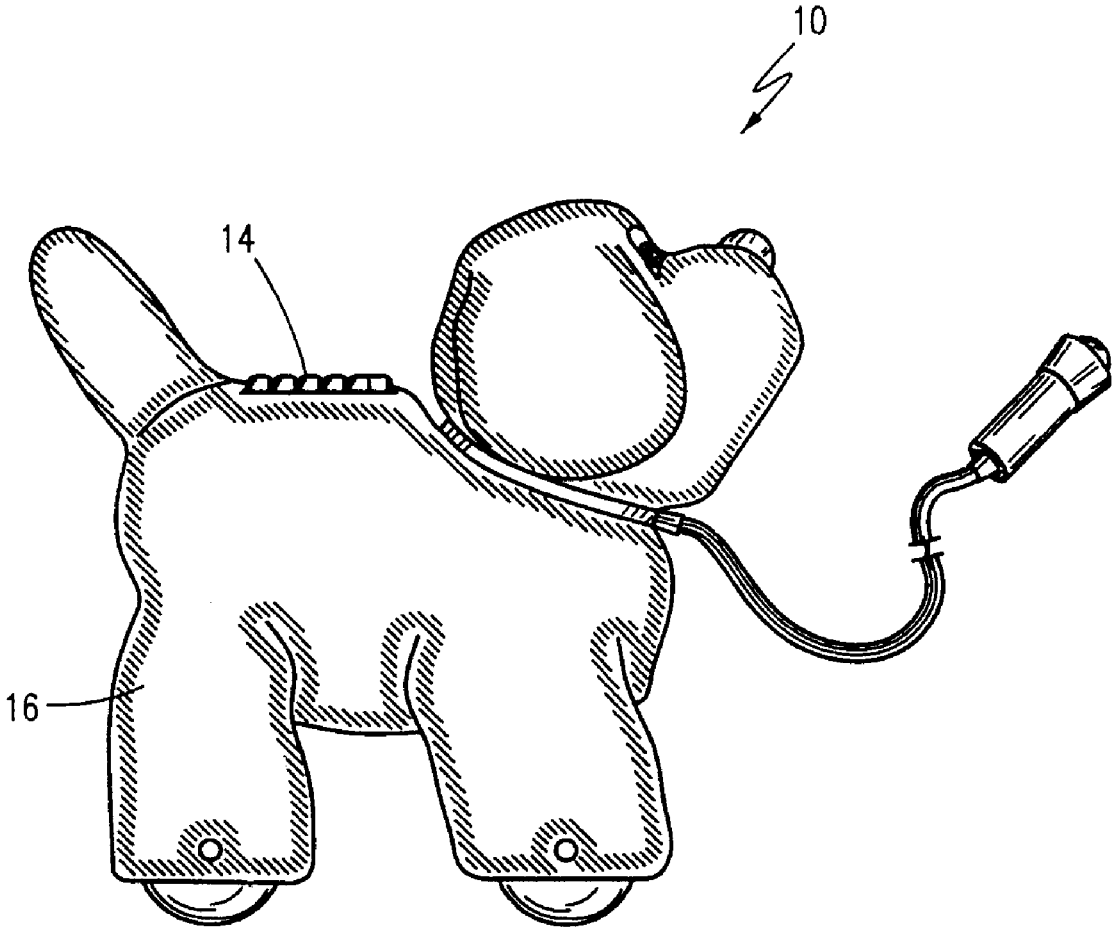
FIG. 1 is a side elevational view of a pull along toy for a child according to the preferred embodiment of the present invention.

Referring now to FIG. 1, a pull along toy 10 for a child 12 is provided, according to the present invention, with an integral cassette recorder 14. For purposes of the present disclosure, the invention has a decorative outer shell 16 that will take the shape of a four legged animal, herein shown as a dog but also capable of being formed as a cat, a lion, a horse, or the like. However, is can be seen by one skilled in the art that any number of decorative outer shells can be utilized shaped as any crawling or walking creature, such as a bug, spider, or the like. Although any conventional method of forming a decorative outer shell 16 can be utilized, for purposes of disclosing the best mode as presently anticipated it is felt that an injection molded, plastic outer shell is utilized; or, alternatively, a plush toy outer shell, utilizing fabric and batting as is conventionally known for making decorative plush toys, is utilized.

Figure 2:
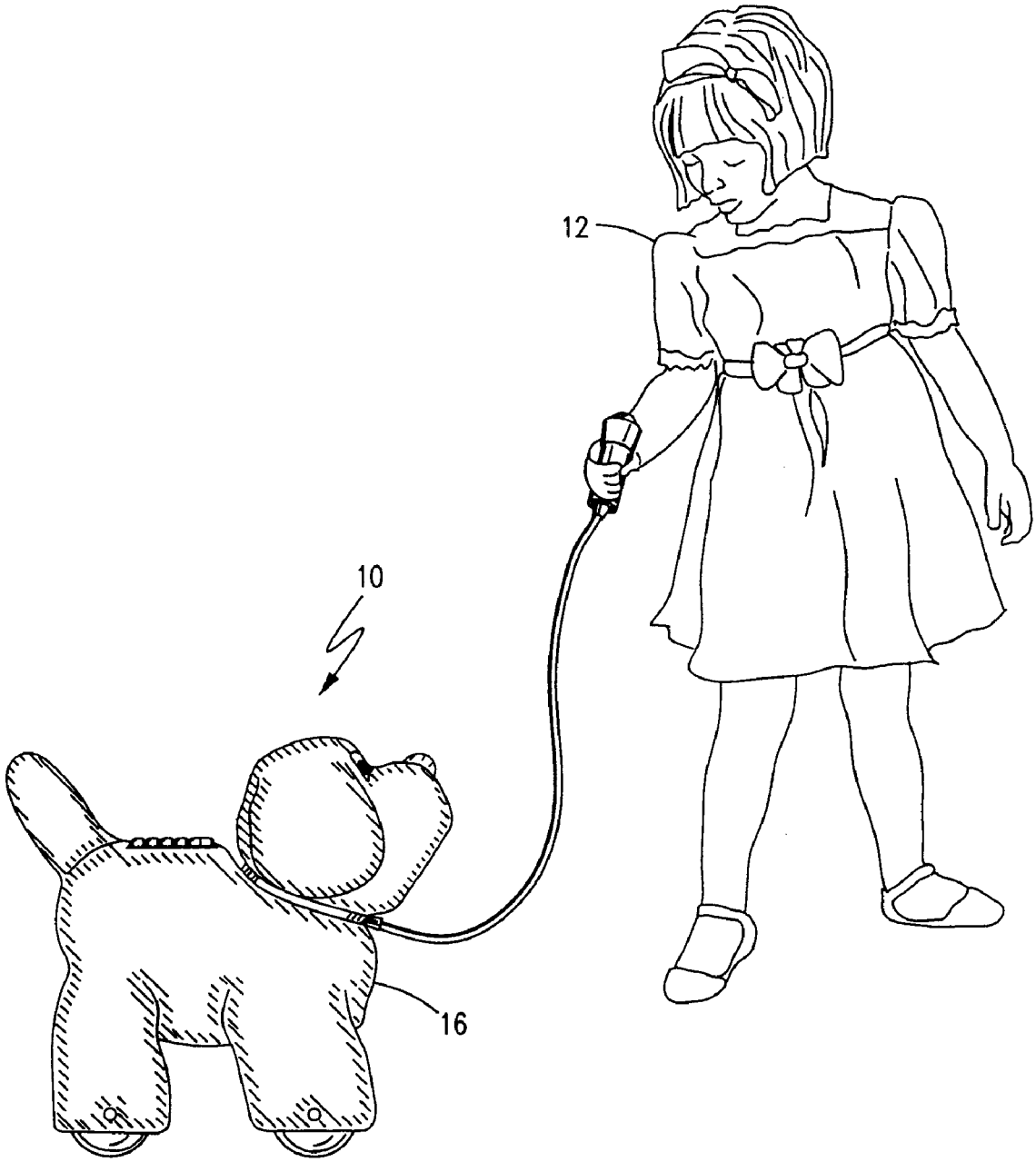
FIG. 2 is a perspective view thereof, shown in use with a child.
Figure 3:
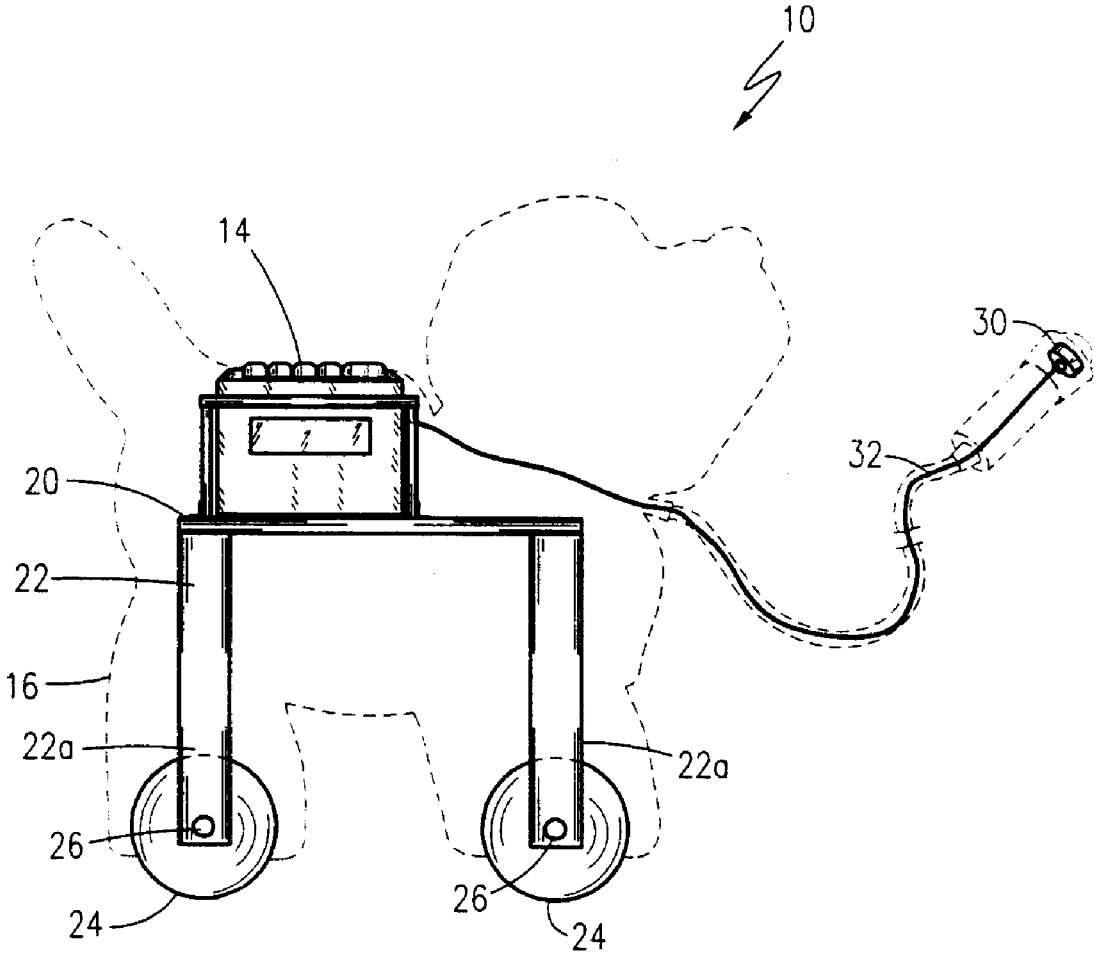
FIG. 3 is an internal exploded schematic shows the microphone cable, tape recorder, and rolling mechanisms mounted therein.

Taking the shape of a four legged animal, as shown in conjunction with FIG. 2 and FIG. 3 an internal support frame 20 is formed, having four vertical members 22, one traveling to the bottommost end of each leg structure. At the vertical bottom end 22*a* of each vertical member 22 is a wheel 24 rotatably mounted on an axle 26. With each wheel 24 extending downward past each leg structure in this manner, the decorative outer shell 16 that has the shape of a four legged animal can be easily rolled along any horizontal surface, such as a floor.

As best shown in FIG. 3, a cassette recorder 14 is built into the main body member of the animal 16, and is supported by the internal support frame 20. It is envisioned that the cassette recorder 14 would be provided with common functions such as play, record, fast-forward, rewind and stop, but also include a sing-along feature, such as with a conventional karaoke machine, that allows a user to verbally articulate into a microphone 30 to communicate with an integral speaker provided with the tape recorder 14. A leash 32 of the animal is formed by a strong electrical cable exiting from the neck area of the animal. Located at the end of the leash/cable is the microphone 30, for use in recording audio content.

2. Operation of the Preferred Embodiment

To use the present invention, a user can pull the toy 10 along a horizontal surface by the leash 32, having the wheels 24 roll the body 16. When playing music in the recorder 13, the user can also "sing along" by directing his or her voice into the end of the leash 32 housing the microphone.

As designed, a device embodying the teachings of the present invention is easily applied. The foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A toy comprising:

a decorative outer shell that forms a shape of an animal having four individual leg structures;

an integral cassette recorder mounted within said decorative outer shell, said cassette recorder capable of allowing a user to verbally articulate into a microphone to communicate with an integral speaker provided with said cassette recorder;

a leash affixed to said decorative outer shell; and a microphone for use in communicating audio content to said cassette recorder, said microphone including an electrical cable traversing within said leash.

2. The toy of claim 1, wherein said decorative outer shell further comprises:

an internal support frame having four vertical members, wherein each one of said vertical members travels to a bottommost end of each respective leg structure; and a wheel rotatably mounted on an axle at a vertical bottom end of each said vertical member with each wheel extending downward past each leg structure.

3. The toy of claim 2, wherein said decorative outer shell is formed from injection molded plastic.

4. A toy comprising:

a decorative outer shell having four legs;

an internal support frame having four vertical members, wherein each one of said vertical members travels to a bottommost end of each respective leg;

an axle affixed at a vertical bottom end of each said vertical member;

a wheel rotatably mounted on each said axle, each said wheel extending downward past each leg;

a cassette recorder mounted within said internal support frame, said cassette recorder capable of providing operational functions selected from the group consisting of play, record fast-forward, rewind and stop; and a microphone in communication with an integral speaker provided within said cassette recorder, said microphone exiting from said outer shell such as to form an animal leash.

5. The toy of claim 4, wherein said cassette recorder further allows a user to verbally articulate into said microphone, said speaker transmitting said verbal articulation simultaneous with the playing of any cassette played within said cassette recorder.

* * * * *